United States Patent [19]

Yonekawa et al.

[11] Patent Number: 4,726,525

[45] Date of Patent: Feb. 23, 1988

[54] VIBRATING ELEMENT FOR ULTRASONIC INJECTION

[75] Inventors: Yoshiaki Yonekawa; Yoshinobu Nakamura; Yoshiyasu Oba, all of Saitama, Japan

[73] Assignee: Toa Nenryo Kogyo Kabushiki Kaisha, Tokyo, Japan

[21] Appl. No.: 861,480

[22] Filed: May 9, 1986

[30] Foreign Application Priority Data

May 13, 1985 [JP] Japan ..... 60-100939

[51] Int. Cl.[4] ..... B05B 17/06; F02M 61/04; F23D 11/34

[52] U.S. Cl. ..... 239/102.2; 239/501

[58] Field of Search ..... 239/102.1, 101, 102.2, 239/4, 533.12, 500, 501, 590.5, 380; 261/DIG. 48

[56] References Cited

U.S. PATENT DOCUMENTS

| | | | |
|---|---|---|---|
| 578,461 | 3/1897 | Mertz | 239/498 |
| 1,659,538 | 2/1928 | Angrove . | |
| 1,730,664 | 10/1929 | Kruse | 239/590.5 |
| 1,758,119 | 5/1930 | Le Moon | 239/460 |
| 1,954,173 | 4/1934 | Histed | 239/489 X |
| 2,596,341 | 5/1952 | McCreery et al. | 239/590.5 X |
| 2,712,962 | 7/1955 | Goddard | 239/500 X |
| 3,110,444 | 11/1963 | Eakins | 239/500 |
| 3,317,139 | 5/1967 | Freeland | 447/634 |
| 3,373,752 | 3/1968 | Inoue | 239/4 X |
| 3,749,318 | 7/1973 | Cottell | 239/102 |
| 3,756,575 | 9/1973 | Cottell | 239/102.2 X |
| 4,197,997 | 4/1980 | Wu et al. | 239/102 |
| 4,350,302 | 9/1982 | Gruber et al. | 239/500 |
| 4,372,491 | 2/1983 | Fishgal | 239/102 |
| 4,403,741 | 9/1983 | Moriya et al. | 239/585 |
| 4,408,722 | 10/1983 | Freland | 239/533.12 |
| 4,474,326 | 10/1984 | Takahashi | 239/102 |
| 4,496,101 | 1/1985 | Northman | 239/102 |
| 4,501,406 | 2/1985 | Walther et al. | 251/30 |
| 4,541,564 | 9/1985 | Berger et al. | 239/102 |

FOREIGN PATENT DOCUMENTS

| | | | |
|---|---|---|---|
| 0159189 | 10/1985 | European Pat. Off. | 239/102 |
| 861344 | 7/1949 | Fed. Rep. of Germany . | |
| 2239408 | 2/1974 | Fed. Rep. of Germany | 313/239 |
| 786492 | 9/1935 | France | 239/498 |
| 197801 | 1/1978 | U.S.S.R. | 239/501 |

*Primary Examiner*—Andres Kashnikow

*Attorney, Agent, or Firm*—Seidel, Gonda, Goldhammer & Abbott

[57] ABSTRACT

The present invention consists of a vibrating element for ultrasonic injection in which the edged portion for atomizing liquid includes helical screw threads having either a uniformed diameter or varying diameters.

8 Claims, 7 Drawing Figures

VIBRATING ELEMENT FOR ULTRASONIC INJECTION

TECHNICAL FIELD

This invention relates generally to an ultrasonic injecting apparatus such as an ultrasonic injection nozzle, and particularly to a vibrating element for use with an ultrasonic injecting apparatus for atomizing liquid either intermittently or continuously. Such vibrating element may be effectively used with (1) automobile fuel injection valves such as electronically controlled gasoline injection valves and electronically controlled diesel injection valves, (2) gas turbine fuel nozzles, (3) burners for use or industrial, commercial and domestic boilers, heating furnaces and stoves, (4) industrial liquid atomizers such as drying atomizers for drying liquid materials such as foods, medicines, agricultural chemicals, fertilizers and the like, spray heads for controlling temperature and humidity, atomizers for calcining powders (pelletizing ceramics), spray coaters and reaction promoting devices, and (5) liquid atomizers for uses other than industrial ones, such as spreaders for agricultural chemicals and antiseptic solution.

BACKGROUND ART

Ultrasonic injection nozzles have been widely used in place of conventional pressure spray burners or liquid spray heads in the various applications as mentioned above to atomize liquid. The term "liquid" herein used is intended to mean not only liquid but also various liquid materials such as solution, suspension and the like.

The present applicant proposed an ultrasonic injection nozzle in Japanese Patent Application No. 59-77572 (corresponding to U.S. patent application Ser. No. 723,243, filed Apr. 15, 1985) which had overcome the drawbacks to the injection nozzle used on the conventional spray burners or liquid spray heads as well as the prior art ultrasonic injection nozzle.

The ultrasonic injection nozzle as disclosed in the aforesaid patent application comprises an ultrasonic vibration generating means, and an elongated vibrating element connected at one end to said ultrasonic vibration generating means and having an edged portion at the other end, said edged portion being adapted to be supplied with liquid for atomization. It has been found that such ultrasonic injection nozzle is capable of atomizing a large quantity of liquid intermittently or continuously and may be used very effectively in the various applications stated above.

However, it has been found through further studies and experiments that in such ultrasonic injection nozzle as well, the configuration of the vibrating element has a great effect on the amount of liquid which the nozzle is capable of atomizing.

The present invention relates to improvements on the vibrating element as used with the ultrasonic injection nozzle of the type disclosed in the aforesaid patent application and other ultrasonic injecting apparatus.

SUMMARY OF THE INVENTION

It is an object of this invention to provide a vibrating element for use with an ultrasonic injection nozzle which is capable of delivering liquid intermittently or continuously.

It is another object of the invention to provide a vibrating element for an ultrasonic injection nozzle which is capable of delivering and consistently atomizing or spraying a large quantity of liquid as compared with the conventional injection nozzle and ultrasonic injection nozzle.

It is yet another object of the invention to provide a vibrating element for ultrasonic atomization which is capable of accomplishing consistent atomization in that there is no change in the conditions of atomizing (flow rate and particle size) depending upon the properties, particularly the viscosity of the supply liquid.

The aforesaid objects may be accomplished by the vibrating element for ultrasonic atomization according to the present invention.

Briefly, the present invention consists in a vibrating element for ultrasonic injection in which the edged portion for atomizing liquid includes helical screw threads having either a uniform diameter or varying diameters.

Specific embodiments of the present invention will now be described by way of example and not by way of limitation with reference to the accompanying drawings.

DESCRIPTION OF THE PREFERRED EMBODIMENTS

Figure 2:
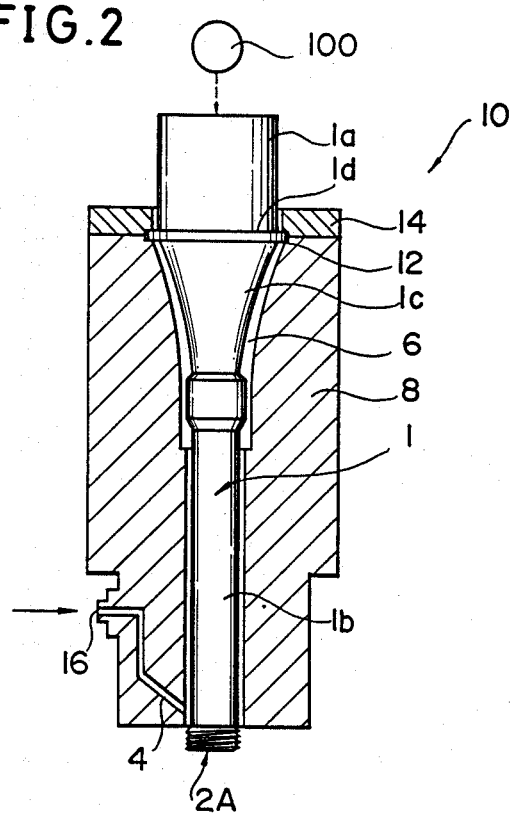
FIG. 2 is a cross-sectional view of an ultrasonic injecting apparatus incorporating the vibrating element according to this invention.

FIG. 2 illustrates an ultrasonic injecting apparatus with which a vibrating element according to this invention may be used. While the present invention may be suitably used in ultrasonic injection apparatus for the various applications as indicated hereinabove, it will be described with reference to a fuel nozzle for a gas turbine engine.

Referring to FIG. 2, an injecting apparatus which is a fuel nozzle for a gas turbine engine in the illustrated embodiment includes a generally cylindrical elongated valve body 8 having a central bore 6 extending through the center thereof. Disposed extending through the central bore 6 is a vibrating element 1 which includes an upper body portion 1*a*, an elongated cylindrical vibrator shank 1*b* having a diameter smaller than that of the body portion 1*a*, and a transition portion 1*c* connecting the body portion 1*a* and the shank 1*b*. The body portion 1*a* has an enlarged diameter flange 1*d* which is attached to the valve body 8 by a shoulder 12 formed in the upper end of the valve body and an annular vibrator retainer 14 fastened to the upper end face of the valve body by bolts (not shown).

The forward end of the vibrating element 1, that is, the forward end of the shank 1*b* is formed with an edged portion 2A the details of which will be described below. The valve body 8 is formed through its lower portion with one or more supply passages 4 for feeding said edged portion 2A with fuel. The fuel inlet port 16 of the supply passage 4 is fed with liquid fuel through an exterior supply line (not shown) from an external source of fuel (not shown). The flow and flow rate of fuel are controlled by a supply valve (not shown) disposed in the exterior supply line.

With the construction described above, the vibrating element 1 is continuously vibrated by an ultrasonic generator 100 operatively connected to the body portion 1*a*. Liquid fuel is thus supplied through the exterior line, the supply valve and the supply passage 4 to the edged portion 2A where the fuel is atomized and discharged out.

Figure 1:
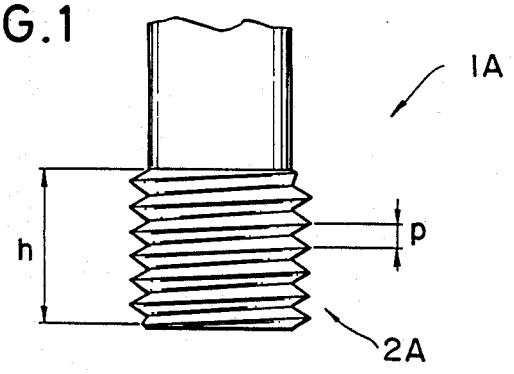
FIG. 1 is a fragmentary cross-sectional view of one embodiment of the ultrasonic injecting vibratory element according to the present invention.

One embodiment of the vibrating element according to this invention is illustrated in FIG. 1. The vibrating element 1A in this embodiment has an edged portion 2A comprising helical grooves or screw threads of uniform diameter formed in the forward or lower end portion of the element. While the screw threads may be of any desired shape provided that they define an edged portion, a triangular thread may be usually employed with the angle of thread in the range of 10° to 150°. The pitch P of thread may be usually about 0.5 mm but is not limited thereto. For the total length or height h of the edged portion 2A in the range of 1 mm to 3 cm, the pitch P may be such that the number of threads will be two to six and preferably two to eight. Further, while the screw thread is shown as a single flight screw in the illustrated embodiment, it may be any multiple thread screw such as a two- to four- start screw, for example. Of importance is it that the geometry of the helical grooves or screw threads as shown in FIG. 1 be such as to be able to reduce the liquid fuel to a thin film and impart vibrations to the liquid.

As indicated above, the edged portion 2A of the vibrating element according to this invention is formed around its outer periphery with helically extending edges which facilitate smooth flow of the liquid in a generally axial direction of the element 1A. In addition, the entire edged portion may be effectively utilized to increase the vibrating surface area effective for atomization, resulting in a great increase in the amount of spray being produced as well as providing very stable and consistent condition in which the spray is produced.

With the construction described above, as liquid which is fuel in the illustrated embodiment is passed to the edged portion 2A, the stream of fuel is severed and atomized at the screw thread edge due to the vertical vibrations imparted to the vibrating element 1A. Fuel is first partially atomized at the screw thread crest or edge adjacent to the liquid supply port, and the excess portion of the fuel which has not been at said screw thread edge flows down the helical screw groove to be handled and atomized by the continuous downstream screw thread edge. It is to be understood that at a higher flow rate of fuel a larger effective surface area is required for atomization, requiring a longer helical groove. At a lower flow rate, however, a shorter helical groove is required before the atomization of fuel is completed. Thus, with the vibrating element 1A according to this invention, the length of the screw thread edge (crest) required for atomization will vary with changes in the flow rate so as to provide generally uniform conditions such as the thickness of liquid film at every location where the atomization takes place, resulting in uniform particle size of the droplets being atomized. In addition, this vibrating element accommodates a full range of flow rates usually required for atomization, so that atomization of various types of liquid material may be accomplished, whether it may be on an intermittent basis or a continuous basis. Further, as explained above, supply of liquid to the edged portion is continuously effected via the screw thread groove to insure very consistent spray process.

Figure 3:
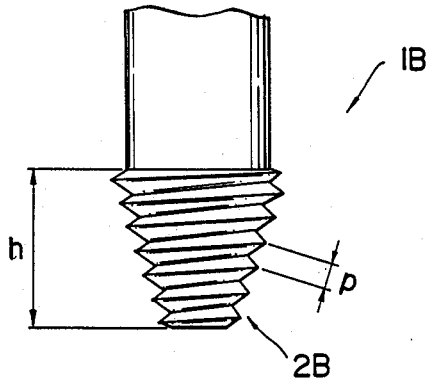
FIGS. 3–5 are fragmentary cross-sectional views of alternate forms of the ultrasonic injecting vibratory element according to this invention.

The vibrating element according to this invention is not limited to the configuration described above, but may be provided with a screw thread having progressively increased outer diameters as in the vibrating element shown in FIG. 3 or a screw thread having progressively reduced outer diameters.

Figure 4:
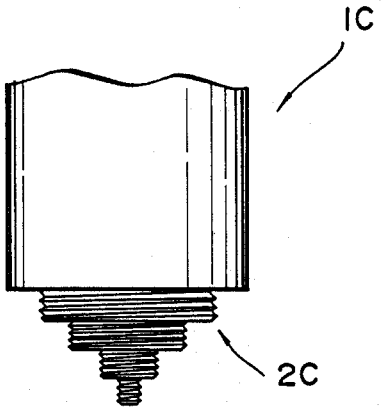

FIG. 4 illustrates still another embodiment of this invention. In this embodiment the edged portion 2C of the vibrating element 1C is in the form of a staircase as in the conventional vibrating element, but the riser or vertical wall of each step is formed with screw threads to define a great number of edges.

Figure 5:
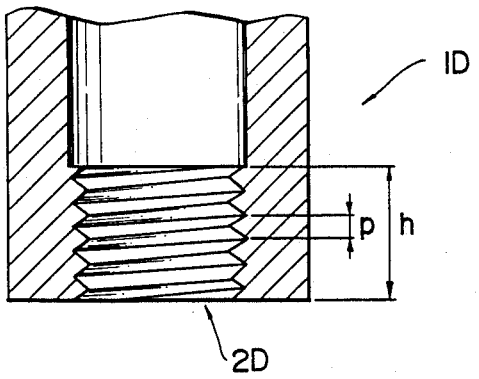
Figure 6:
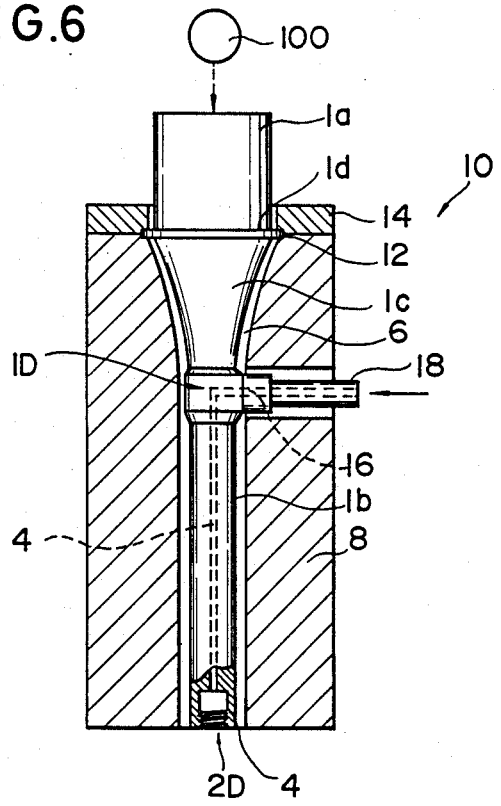
FIG. 6 is a cross-sectional view of an ultrasonic injecting apparatus incorporating the vibrating element shown in FIG. 5.

FIG. 5 shows a vibrating element 1D according to an alternate embodiment of this invention in which the edged portion 2D is formed around the inner periphery of the forward end portion of the vibrating element. As shown in FIG. 6, in an injection nozzle 10 incorporating such vibrating element 1D, liquid is supplied to the edged portion 2D through a liquid supply passage 4 formed through the vibrating element. A fuel supply port 18 is provided in the vibrating element 1D at a location where the amplitude of vibration is minimal, that is, at a node. Accordingly, the fuel supply port 18 would be actually positioned well below the position shown in FIG. 6.

Figure 7:
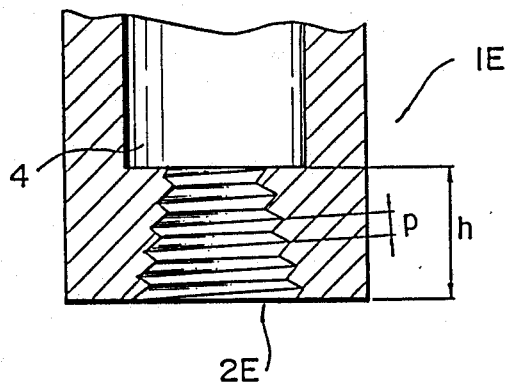
FIG. 7 is a cross-section of a modified ultrasonic injecting vibratory element.

FIG. 7 illustrates an embodiment further modified from the vibrating elements shown in FIG. 5. The vibrating element 1E in this embodiment has an edged portion 2E of progressively increased diameters.

The geometry of the screw threads comprising the edged portions 2B–2E of the vibrating elements 1B–1E is designed in a manner similar to that described with reference to the vibrating element 1A of FIG. 1.

An actual example of various parameters and dimensions applicable to the ultrasonic injection nozzle utilizing a vibrating element according to this invention are as follows:

| | |
|---|---|
| Output of ultrasonic vibration generating means: | 10 watts |
| Amplitude of vibrating element: | 34 μm |
| Frequency of vibration: | 38 KHz |
| Geometry of vibrating element (shown in FIG. 1) | |
| Outer diameter of screw thread: | 7 mm |
| Shape of thread: | Triangular thread |
| Included angle: | 60° |
| Number of threads: | 5 |
| Length of threaded portion: | 1 cm |
| Type of fuel: | Kerosine |
| Flow rate of fuel: | 10 $cm^3/S$ |
| Injection pressure: | 5 $kg/cm^3$ |
| Temperature of fuel: | Normal temperature |
| Material of which vibrating element is made: | Titanium |

EFFECTS OF THE INVENTION

As explained hereinabove, it is to be appriciated that the vibrating element according to this invention provides for supplying a large quantity of liquid in a stable and consistent manner, as compared to the prior art vibrating element used on the conventional injection nozzle or ultrasonic injection nozzle, and provides a large capacity for stable atomization with no substantial changes in the atomization conditions such as flow rate and particle size depending upon the properties, particularly the viscosity of supply liquid. Further, the vibrating element of this invention does not exhibit deterioration in the quality of atomization even at a low flow rate.

We claim:

1. In an article for use in combination with an ultrasonic injection nozzle for liquid materials, said nozzle including an ultrasonic generating means wherein the improvement comprises an element having a longitudinal axis and a first and second ends, said first end adapted to be connected to said ultrasonic generating means, and said second end of said element having an edged portion on which a helical screw thread is formed, said helical screw thread being adapted to sever and atomize said liquid material.

2. The article according to claim 1, wherein said edged portion is defined on an outer peripheral wall of said second end of said element, and said helical screw thread being formed on said outer peripheral wall.

3. The article according to claim 1, wherein said edged portion is formed on an inner peripheral wall of said second end of said element.

4. The article according to claim 2, wherein said element has a uniform diameter.

5. The article according to claim 2, wherein said element has a varying diameter.

6. The article according to claim 3, wherein said element has a uniform diameter.

7. The article according to claim 3, wherein said element has a varying diameter.

8. The article according to claim 2, wherein said edged portion is in the form of a staircase.

* * * * *